United States Patent [19]

Crasnianski

[11] 4,196,664

[45] Apr. 8, 1980

[54] HOT DIE AND FOIL PRINTER

[76] Inventor: Serge P. Crasnianski, 75 rue Bizanet, 38100 Grenoble, France

[21] Appl. No.: 901,316

[22] Filed: May 1, 1978

[30] Foreign Application Priority Data

May 9, 1977 [FR] France ..... 77 14060

[51] Int. Cl.[2] ..... B44B 5/02

[52] U.S. Cl. ..... 101/27; 101/DIG. 4; 101/298

[58] Field of Search ..... 101/DIG. 4, 382 MV, 101/27, 287, 297, 298, 299, 306, 316, 317, 322, 407 BP; 74/608, 613-617; 192/133

[56] References Cited

U.S. PATENT DOCUMENTS

| | | | |
|---|---|---|---|
| 2,547,602 | 4/1951 | Schmitt | 101/DIG. 4 |
| 2,620,726 | 12/1952 | Tookelson | 101/316 X |
| 2,768,723 | 10/1956 | Ganio | 74/616 X |
| 3,101,665 | 8/1963 | Hall | 101/382 MV |
| 3,589,279 | 6/1971 | Deutsch | 101/27 |
| 3,643,593 | 2/1972 | Krosel | 101/27 |
| 3,774,529 | 11/1973 | Filsinger et al. | 101/27 |
| 4,029,010 | 6/1977 | Deisting | 101/407 BP X |

*Primary Examiner*—Edward M. Coven

*Attorney, Agent, or Firm*—Frishauf, Holtz, Goodman & Woodward

[57] ABSTRACT

In a printing press comprising a type-bearing heating block, means adapted alternately to apply the block under pressure along a printing surface onto a sheet to be printed located on the surface and to release the block therefrom, and means to interpose a stamping foil between the type-bearing block and a sheet to be printed located on the printing surface, the improvement wherein the printing surface is inclined sufficiently for a printed sheet to slide from the surface under the influence of gravity, and means are provided to hold a sheet in position on the surface which means are releasable by movement of the type-bearing block away from the printing surface after a printing operation to allow the sheet to slide from the printing surface.

10 Claims, 11 Drawing Figures

FIG.4
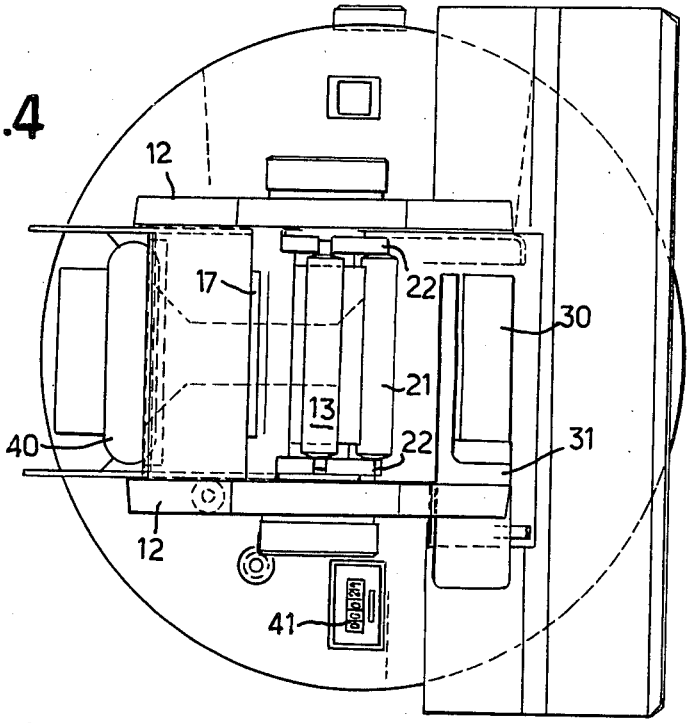
FIG.7
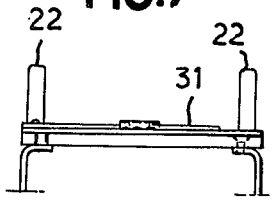
FIG.5
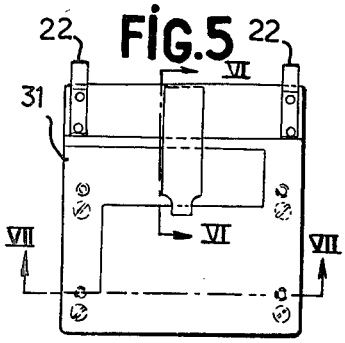
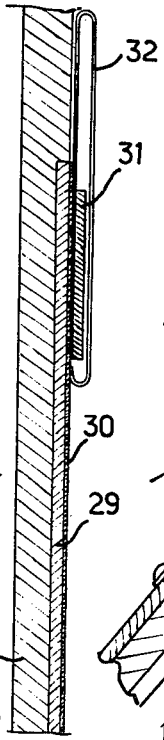
FIG.6
FIG.8
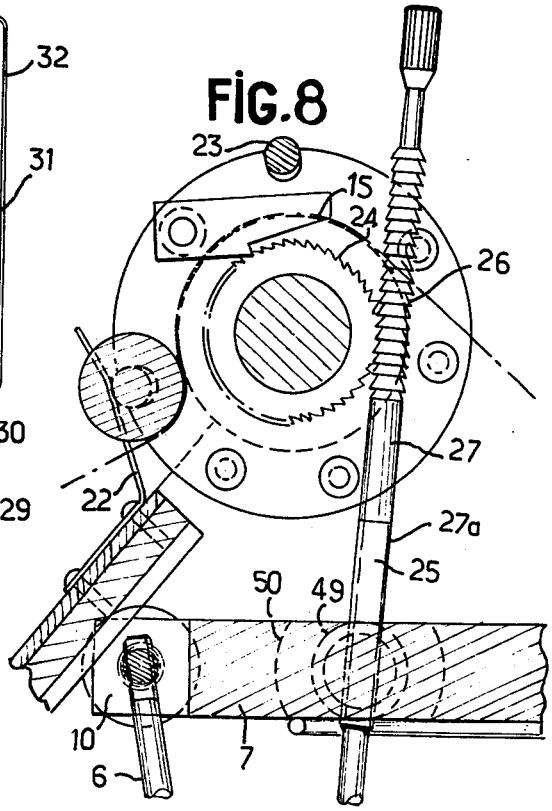

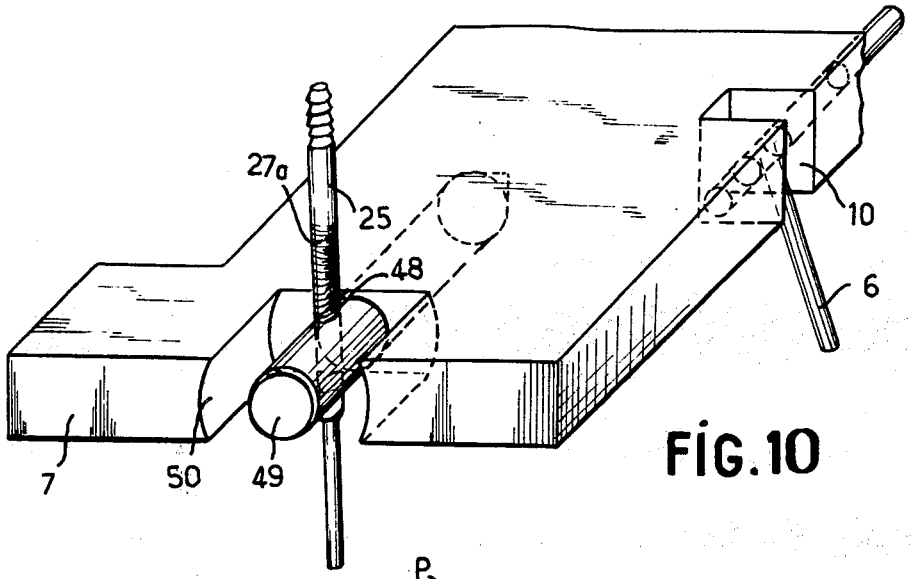
FIG. 10
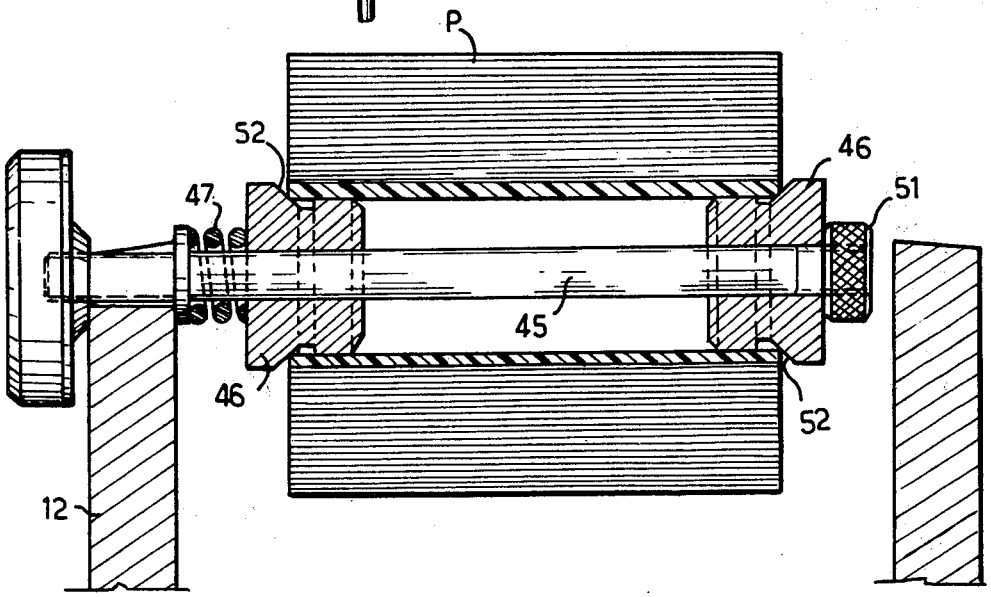
FIG. 9
FIG. 11
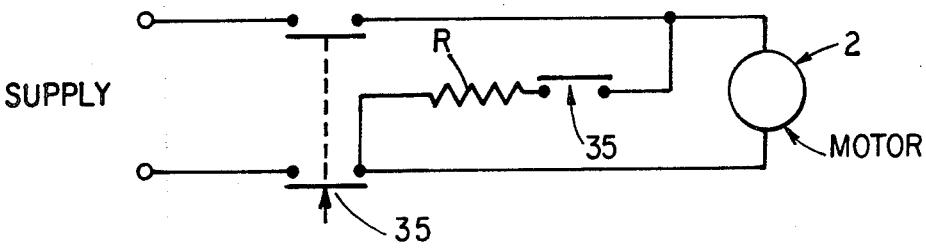

HOT DIE AND FOIL PRINTER

FIELD OF THE INVENTION

The invention relates to printing presses, and in particular to dry printing presses known as "gold tooling presses".

BACKGROUND TO THE INVENTION

A printing press is known, for printing visiting cards, which comprises a plate receiving a card to be printed. A film is placed between the plate and a heated type-bearing block. Such a film is generally called a hot "gilding" film or strip, though it permits obtaining printing that is not only gilt but also silvered or coloured. These films are supplied in particular under the name of "stamping foil" by Messrs. Markem Corporation, Keene, New Hampshire, U.S.A. A lever mechanism permits pressing the film onto the sheet to be printed by means of the type-bearing block. Under the action of heat and pressure, the type, which comes in contact with the foil, causes the latter to reproduce onto the card the image of the type.

To print visiting cards, it is necessary to position a virgin visiting card on the plate with the aid of a gauge, lower the type-bearing block onto the foil and the plate, raise it again and withdraw the printed visiting card. The latter operation is all the more awkward as it is carried out transversely to the direction of feed of the foil from one printing to the next, an obstacle being provided and extending in a direction perpendicular to such direction of feed to prevent an untimely movement of the card, and especially as a safety measure.

SUMMARY OF THE INVENTION

The invention seeks to obviate or minimize these drawbacks. It permits increasing considerably the rate of production of visiting cards, while retaining for the press a relatively simple structure.

The invention provides in a printing press comprising a type-bearing heating block, means adapted alternately to apply the block under pressure along a printing surface onto a sheet to be printed located on the surface and to release the block therefrom, and means to interpose a stamping foil between the type-bearing block and a sheet to be printed located on the printing surface, the improvement wherein the printing surface is inclined sufficiently for a printed sheet to slide from the surface under the influence of gravity, and means are provided to hold a sheet in position on the surface which means are releasable by movement of the type-bearing block away from the printing surface after a printing operation to allow the sheet to slide from the printing surface.

It will be understood that automatic withdrawal of the sheets or cards is thereby achieved and the cards released from the press in this way form a stack in a magazine which may be provided at the bottom of the ramp formed by the printing surface or plate.

Satisfactory sliding may be promoted by covering the plate with a foil which has a low coefficient of friction and which is held advantageously on the plate by forming the latter as a flexible plate of magnetized material which holds the foil made of a magnetic material.

By firmly locating the stamping foil with respect to the type-bearing block it is prevented from hindering positioning of a card in the press and sliding of the card from the press after a printing operation.

According to a preferred embodiment which provides a simple and reliable construction, the said applying means may comprise means for mounting the type-bearing block for pivotal movement relative to the fixed printing surface about an axis remote from the printing surface but contained in the same plane as the latter. The axis is preferably eccentric with respect to an axis of rotation of the shaft to allow adjustment of the shaft so as to hold the swivelling axis of the block in the plane of the printing surface, whatever may be the thickness of the sheet to be printed.

According to a feature of the invention any danger of pinching the hand of the operator between the plate and the type-bearing block may be prevented by means of a rigid bar framing the block and movable relative thereto such that movement of the bar relative to the block, e.g. on engagement with the hand of an operator, cuts off the electrical feed to the motor, this being effected preferably by means of two series-switches carried by the block. Provision may also be made for a restart time switch.

BRIEF DESCRIPTION OF THE DRAWINGS

FIG. 4 is a plan view of the press in FIG. 3;

FIG. 5 is a top view of the card receiving plate;

FIG. 6 is a view on an enlarged scale along line VI—VI of FIG. 5;

FIG. 7 is a view along line VII—VII of FIG. 5;

FIG. 8 is a cross-sectional view illustrating the control for the stepped feed of the foil;

FIG. 9 is a view along line IX—IX of FIG. 1 and

FIG. 10 is a perspective view illustrating the control mechanism for the stepped feed of the foil; and FIG. 11 is a schematic circuit diagram for instantaneously stopping the drive motor of the press.

Figure 1:
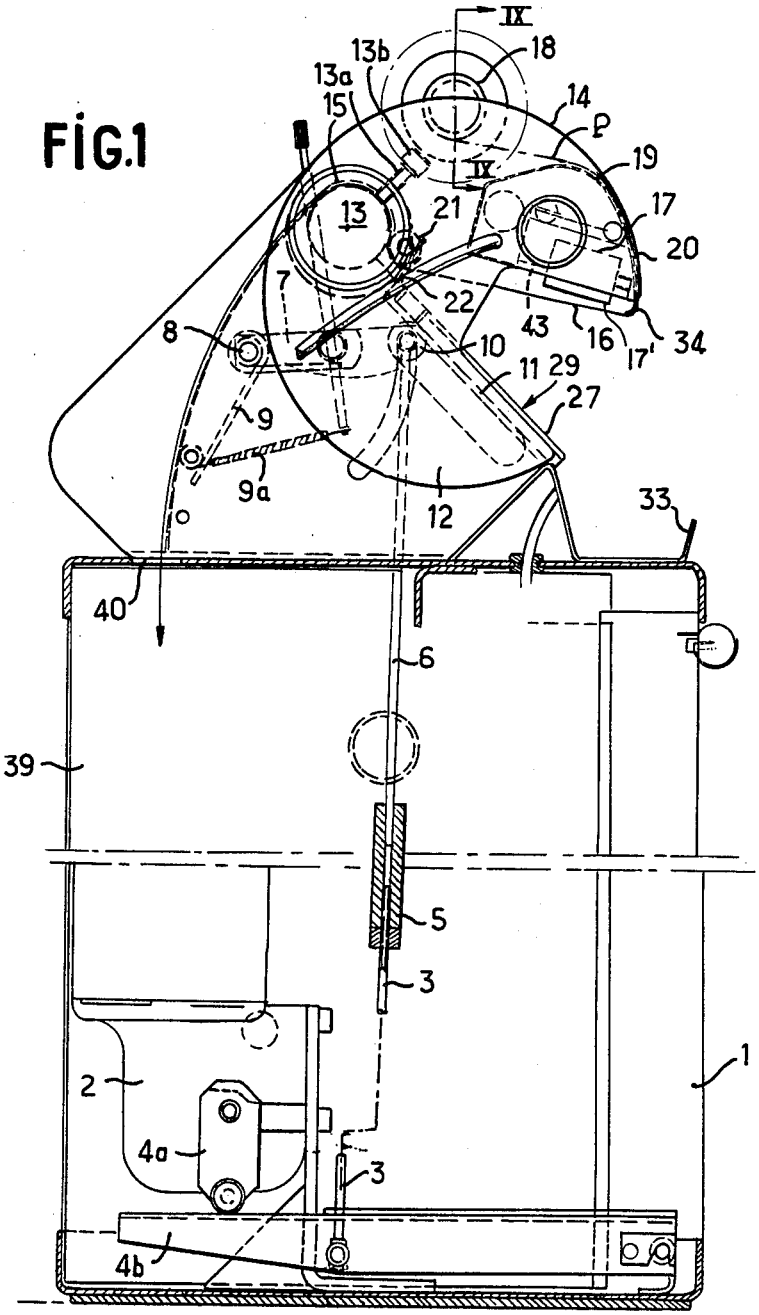
FIG. 1 is a profile view partly in section of a press embodying the invention in the position permitting the introduction of a virgin card to be printed on a card receiving plate of the press, the pedal being nevertheless represented in the printing position.
Figure 2:
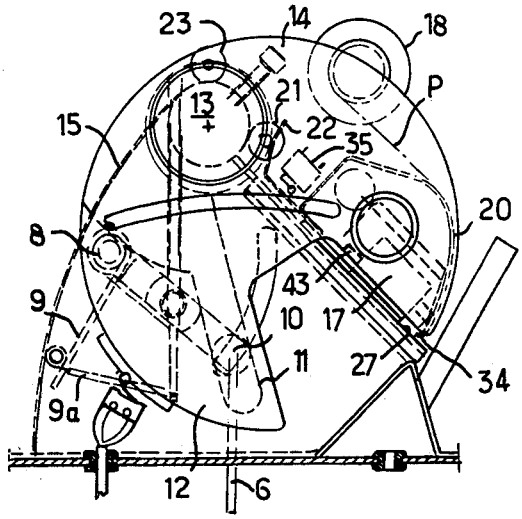
FIGS. 2 and 3 are profile views of an upper part of the press of FIG. 1, respectively in the printing and copy-change positions.

The press comprises a cylindrical housing 1 in the bottom of which a reduction motor 2 is housed. The motor imparts an up and down alternating motion to a threaded rod 3 through a crank-rod system **4*a* and a pedal 4*b*. The threaded rod 3 co-operates with an internal right-hand screw thread at the bottom end of a sleeve 5. One end of a threaded rod 6 co-operates with an internal left-hand thread at the top end of the sleeve 5**.

The other end of the rod 6 engages a small connecting block 7 swivelling about a horizontal axis and returned by a spring 9 to its position corresponding to top dead centre of the system **4*a***.

By rotating the sleeve 5, the pulling force exerted by the rod 6 can be adjusted.

The small block 7 is solid with two end rollers 10 respectively guided in two cam ways 11 provided in two side plates 12 of a cap or hood 14 fixed at the top of the housing 1. Shaft 8 pivots in two bearings made in the plates 12.

The horizontal eccentric shaft 13 for the swivelling of a cap 14 is common with that of a drum 15 for receiving a stamping foil P. The shaft 13 rotates in bearings made in the plates 12. The shaft 13 may be held in a position corresponding to a given degree of eccentricity by means of a locking screw 13*a* controlled by a knob 13*b*.

On the upper portion 16 of the opening of the hood a type-bearing block 17 is housed with a heating resistor having thermometric display and control. A magnet 43 is mounted next to the bottom portion of block 17.

The foil P issuing from an unwinding mandrel 18 carried by the hood conforms to the shape of the surface 19 of the block 17 adjacent to the inner surface of upper portion 16 and, the external curved face 20 of the block 17, lower surface 17' of block 17 carries the type, foil P travels over surface 17; where the type is, and is applied onto the drum 15 by means of a pressing roller 21 impelled by two lateral springs 22. The foil P is able to wind on the drum 15 through a driving roller 23. The step-by-step feed of the foil P and hence its unwinding from a supply roll carried by mandrel 18 is obtained by means of a ratchet wheel 24 wedged on the shaft of the drum 15, locked in one direction by a pawl and engaged by an adjusting rod 25 having an upper portion 26 constituting a rack having annular teeth, a smooth bottom portion 27 and a threaded portion 27*a*. Said threaded portion 27*a* may be screwed to a varying extent into a threaded portion 48 made in a bar 49 extending in an opening 50 of the small rod 7 and solid with it, in such a manner that, on unscrewing or screwing the threaded portion 27*a*, it is possible to adjust the length of the rock 26 co-operating with the wheel 24 and, thus, the feed step of the foil P. The bottom end of the rod 25 is subjected to the action of the small block 7 through the medium of the spring 9 and of a spring 9*a*.

To make it possible to change the rolls of film P, the mandrel 18 (FIG. 9) has a shaft 45, with a straight square section going through only one of plates 12. Two hubs 46 are mounted on the shaft 45. One of the hubs 46 is held by an end of a spring 47 the other end of which comes to abut against one of the plates 12. The other hub 49 is held by a milled nut 51. The reel of foil P is in friction contact with faces 52 at 45° relative to the shaft 45 of the hubs 46.

In the bottom surface 27 of the opening of the cap 14 there appears the fixed block used to hold a visiting card. Said block is supported by the housing 1. It is inclined along a descending slope towards the outside of the opening.

It comprises (FIGS. 5 to 7) a truing up table 28 bearing a magnetized plate or printing surface 29 covered with a foil 30 in a material attracted by the magnet 29 and having a low coefficient of friction. The foil 30 extends only over a bottom portion of the plate 29. On the foil 30 a gauge, in the shape of a flat set-square 31, of magnetizable material, is placed. A blade-shaped spring 32 extends over the foil 30 along the direction of the slope of the inclined plate, thus perpendicularly to the swivelling axis 13 of the cap 14 bearing the block 17. The spring 32 extends upward beyond the foil 30. The free end of the spring 32 faces the magnet 43. When the magnet moves away, it attracts the free end and thus frees any sheet pinched between the foil 30 and the spring 32. This sheet then slides under gravity into a magazine 33 where the printed sheets are stacked.

Figure 3:
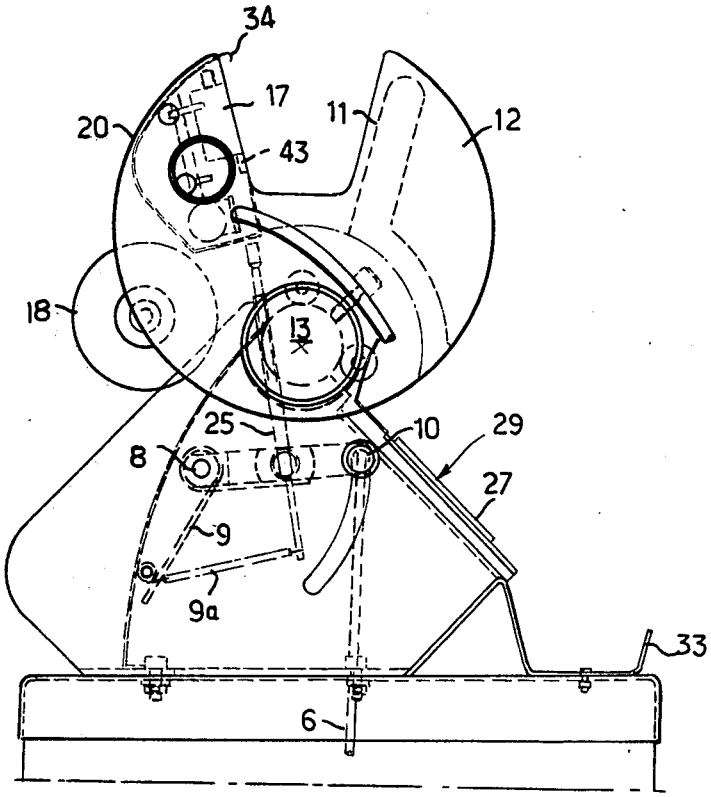

As FIG. 3 shows, it is possible to swivel the hood 14 manually, in such a manner that the printing face of the block 17 comes into a position which is substantially vertical, facilitating change of type.

The printing face is surrounded by a safety gate, or bar 34. The movement of this bar 34, particularly due to the presence of an operator's hand between the plate 29 and the block 17 as these are brought closer together, relative to the block 17, controls two switches 35 which short-circuit the armature of the motor reducer 2 through a resistor R thereby instantly stopping the motor by dynamic breaking, as well known. In addition, provision is made for a restart time-switch of the reduction motor 2.

A counter 41 permits counting the number of printed sheets.

The press operates as follows:

The system 4 controlled by the reduction motor 2 is at top dead centre. The printing face 171 is away from the plate 29. When system 4 moves down, rods 3 and 6 pull the small block 7 downwards. The rollers 10 roll down the ramps 11 and cause swivelling of the hood 14 about the shaft 13. The face 17' and thus block 17 act to press foil P onto the face 27 and thus onto the plate 29.

Printing takes place at bottom dead centre.

Rods 3 and 6 then move upwards. Face 16 moves away from face 27. At the start of this movement magnet 43, rigid with the block 17, moves the spring blade 32 with it thereby releasing the printed card. The printed sheet engaged between the spring 32 and the foil 30 then slides under gravity into the magazine 33.

During the movement of the block 17 away from the plate 29, the operator positions a new sheet to be printed on the foil 30 by means of the gauge 31. He engages the sheet by a movement in a direction substantially parallel to the plate 29, which is thus achieved in a relatively easy manner.

The motion of the block 17 away from plate 29 also moves the foil P away from the plate 29, as the foil is held against the face 19 of block 17.

Small block 7 goes up again as a result of the action of spring 9. It causes the engagement of the rack 26 onto the ratchet wheel 24 thus causing the rotation by one step of the drum 15 and the positioning of a new portion of foil P under the printing face 16. The spent foil P accumulates in a compartment 39 in housing 1 by passing through an opening 40 therein.

What is claimed is:

1. In a printing press comprising a type-bearing heating block, means adapted alternately to apply the block under pressure along a printing surface onto a sheet to be printed located on the surface and to release the block therefrom, and means to interpose a stamping foil between the type-bearing block and a sheet to be printed located on the printing surface, the improvement wherein the printing surface is inclined sufficiently for a printed sheet to slide from the surface under the influence of gravity, and means are provided to hold a sheet in position on the surface which means are releasable by movement of the type-bearing block away from the printing surface after a printing operation to allow the sheet to slide from the printing surface.

2. A press according to claim 1, wherein the heating block is pivotally mounted on the periphery of a shaft having an axis remote from the printing surface but in the same plane as such surface, the shaft being eccentric to enable the block to pivot about an axis in the same plane of a sheet located on the printing surface, whatever may be the thickness of the sheet to be printed.

3. A press according to claim 1, wherein the printing surface is provided by a magnetized plate, and a flat set-square of magnetizable material is firmly positioned on the plate by magnetic attraction to provide a gauge for correct positioning of individual sheets to be printed on the printing surface.

4. A press according to claim 1, wherein said applying means comprise means for adjusting the pressure of the type on the block onto a sheet located on the printing surface.

5. A press according to claim 4, wherein said adjusting means comprise a connecting rod assembly providing a drive connection between a drive motor and the type-bearing block, said assembly comprising a sleeve having internal screw threads of opposite hands at opposite ends thereof, which co-operate with threaded ends of a pair of rods respectively to enable adjustment of the effective length of the connecting rod assembly by rotation of the sleeve, the aforesaid pressure resulting from the elastic deformation of the mechanical assembly.

6. A press according to claim 1, wherein said applying means is motor driven, and the type-bearing block is surrounded by a rigid bar movable relative to the type-bearing block to actuate at least one micro-switch for stopping the press when the bar is engaged during a printing operation by an object interposed between the block and the printing surface.

7. A press according to claim 6, including means operated by actuation of the micro-switch to instantaneously stop the motor comprising means for short-circuiting the armature of the motor across a resistor.

8. A press according to claim 1 wherein said means to interpose a stamping foil include a spring blade attracted by a magnet, said magnet being connected with the type-bearing block.

9. A press according to claim 8, wherein said interposing means further include means to provide a stepped adjustable feed of stamping foil including a rack element having annular ratchet teeth, a ratchet wheel cooperating with the teeth of the rack element, and a drum for driving the foil, and driven by said ratchet wheel, said rack element having a threaded portion threaded into a part of said applying means which moves with a reciprocating motion to apply a stepped drive to the drum, the extent of threaded engagement of the rack element into said part of the applying means permitting adjustment of the feed of the foil.

10. A press according to claim 1, wherein said means to hold a sheet comprise a resilient blade overlying the printing surface and a magnet located adjacent to the type-bearing block to move the blade by magnetic attraction when the block moves away from the printing surface to release a sheet held by the blade on the printing surface.

* * * * *

UNITED STATES PATENT AND TRADEMARK OFFICE

CERTIFICATE OF CORRECTION

PATENT NO. : 4,196,664

DATED : April 8, 1980

INVENTOR(S) : Serge P. CRASNIANSKI

It is certified that error appears in the above-identified patent and that said Letters Patent are hereby corrected as shown below:

Add Assignee: KIS FRANCE,
Grenoble, France

Signed and Sealed this

*Second* Day of *September 1980*

[SEAL]

*Attest:*

SIDNEY A. DIAMOND

*Attesting Officer*

*Commissioner of Patents and Trademarks*